US007343629B2

(12) United States Patent
Hunt

(10) Patent No.: US 7,343,629 B2
(45) Date of Patent: Mar. 18, 2008

(54) RIDING JACKET

(75) Inventor: Juliana Marie Hunt, Green River, WY (US)

(73) Assignee: Chap Up, LLC, Star, ID (US)

( * ) Notice: Subject to any disclaimer, the term of this patent is extended or adjusted under 35 U.S.C. 154(b) by 452 days.

(21) Appl. No.: 10/810,413

(22) Filed: Mar. 26, 2004

(65) Prior Publication Data

US 2004/0199976 A1 Oct. 14, 2004

Related U.S. Application Data

(60) Provisional application No. 60/461,917, filed on Apr. 10, 2003.

(51) Int. Cl.
*A41D 1/02* (2006.01)

(52) U.S. Cl. ..... 2/93

(58) Field of Classification Search ..... 2/113–115, 2/69, 459, 461, 463, 44, 50, 51, 118, 174, 2/203, 207, 244
See application file for complete search history.

(56) References Cited

U.S. PATENT DOCUMENTS 1,157,341 A * 10/1915 Tallerday ..... 2/91
1,250,836 A * 12/1917 Fowler ..... 2/91
2,045,157 A * 6/1936 Mathias ..... 2/16
2,809,375 A * 10/1957 Doron ..... 2/91
4,016,027 A * 4/1977 Kintanar ..... 2/159
4,570,267 A * 2/1986 Appel ..... 2/91
4,601,069 A * 7/1986 Fiore et al. ..... 2/106
4,625,338 A * 12/1986 Starling ..... 2/106
4,706,304 A * 11/1987 Jones ..... 2/91
5,022,092 A 6/1991 Bombrini
5,042,089 A * 8/1991 Carmer ..... 2/55
5,088,116 A * 2/1992 Gould ..... 2/82
5,101,511 A 4/1992 Elverskog
5,454,119 A 10/1995 Thomm
5,628,064 A * 5/1997 Chung ..... 2/70
5,768,706 A 6/1998 Griffith et al.
6,024,091 A * 2/2000 Bennett ..... 128/873
D431,343 S * 10/2000 Sampson ..... D2/610
6,183,339 B1 * 2/2001 Thompson ..... 450/1
D449,422 S * 10/2001 Massie ..... D2/614
6,393,611 B1 * 5/2002 Thompson ..... 2/55
6,430,744 B1 8/2002 Redman et al.
7,028,342 B1 * 4/2006 Nordstrom et al. ..... 2/119
7,066,784 B2 * 6/2006 Peay ..... 450/31
2002/0042937 A1 * 4/2002 Green ..... 2/69
2003/0196242 A1 * 10/2003 Korkor ..... 2/69

* cited by examiner

*Primary Examiner*—Alissa Hoey

(57) ABSTRACT

A jacket that may be used in hot weather is disclosed. The jacket may be particularly useful for motorcycle and equestrian riders. The jacket is sufficiently fashionable and stylish such that it may be worn on other occasions as well. According to some aspects the jacket includes two sleeves, a chest portion, and a back portion. The chest portion is shorter than conventional jackets, and according to some arrangements the chest portion is designed to accent a woman's figure and be worn above the wearer's breastline. A zipper, snaps, buttons, or Velcro, and/or decorative trim may also be added.

1 Claim, 9 Drawing Sheets

RIDING JACKET

RELATED APPLICATIONS

This application claims priority of U.S. Provisional Patent Application Ser. No. 60/461,917 filed 10 Apr. 2003.

FIELD OF THE INVENTION

This invention relates generally to clothing and outer garments, and more particularly to jackets that may be worn for motorcycling, horseback riding, or other events, particularly in warm or hot weather.

BACKGROUND OF THE INVENTION

Motorcycle and horseback riders often wear jackets, chaps, gloves, and other types of coverings while riding their motorcycles and horses. Not only is such apparel considered fashionable and stylish, these jackets may insulate the rider's otherwise exposed skin from sun, wind, or other atmospheric conditions. For many motorcycle and horseback riders, the type and look of their apparel is just as important as the type of motorcycle or horse that the person is riding.

However, because most jackets are designed to insulate wearers from the elements, they are often warm and thick. Consequently, most motorcyclists and horseback riders find that the use of such jackets in warm weather conditions can be uncomfortable or even unbearable. Moreover, for many women, typical jackets hide their figures. Accordingly, there exists a need for a new type of jacket that may be worn while riding in warm or hot weather conditions. In addition, such a new jacket needs to be stylish and fashionable such that it may also be worn on other occasions. The present invention provides a clothing article that addresses some or all of the problems discussed above.

SUMMARY OF THE INVENTION

The present invention provides an article of clothing conducive to riding in warm or hot weather. An article of clothing made according to principles of the present invention may have two long sleeves, and a front and a back that are cut high on the torso. The long sleeves and the front and back protect a rider's shoulders from sunburn, but the high cut front and back allow air circulation in warm or hot weather. Some embodiments also include straps, ties, chains, or other devices to anchor the jacket while riding. The straps, ties, chains, or other devices may attach to a rider's body or a clothing item, preferably at the rider's hip or waist region. The article may be made of denim, leather, suede, or other materials and may be adorned with decorative trim.

In one of many possible embodiments, the present invention provides a jacket comprising two sleeves, a chest portion designed to be worn above a wearer's bust line, and a back portion. The jacket is cut such that the chest portion and the back portion end proximate the wearer's armpits. The chest portion of the jacket may include overlapping flaps and include one or more buttons or snaps, and it may also include Velcro also known as hook and loop fasteners or a zipper. In this embodiments, the jacket is cut such that the chest and back portions are substantially V-shaped. Therefore, the chest portion curves upward from the armpits to a first point that is positioned above the breasts of the wearer and then curves downwards to a second point that is located between the breasts of the wearer. The back extends in a general V-shape from an armpit region of the article of clothing to a waist region. The jacket may also include one or more chains or tie straps attached to the chest portion. The chains or straps may have spring-loaded fasteners and may attach to rings at the base of the chest portion and at the base of the V-shaped back. The jacket may be made of denim, leather, suede, or other materials and may be trimmed with decorative fringe.

Another aspect of the invention provides an article of clothing including a front and a back, and pair of sleeves. The front has first and second overlapping closable flaps disposed between the sleeves, the first and second closable flaps cut at least partially above a breastline. The back may also be cut above the breastline. However, the back may also extend in a general V-shape from an armpit region of the article of clothing to a waist region. The article may include at least one anchor line extending from a bottom portion of the front. Alternatively, the article may include a crossing anchor strap attached at a middle portion to the front, and having distal ends extending from the front, looping around a wearer, and tied together in a knot. The two flaps may comprise Velcro attachments.

Another aspect of the invention provides an article of clothing including a collar, first and second sleeves, first and second shoulder covering portions, first and second armpit portions, and a front portion extending only between the first and second armpit portions and the first and second shoulder covering portions. The article also includes a back portion, which may extend below the armpit portion into a general V-shape. According to some embodiments the front portion comprises a substantially straight bottom edge extending from the first armpit portion to the second armpit portion. However, according to other embodiments the front portion comprises a middle and a bottom edge, the bottom edge including a first arc extending up from the first armpit portion toward the collar and back down to the middle, and a second arc extending up from the second armpit portion toward the collar and back down to the middle. The article may include first and second anchor lines comprising first and second ends, where the first ends of the first and second anchor lines each attach to the middle, and the second ends of the first and second anchor lines include fasteners for attachment to a clothing item at a wearer's hips. Alternatively, the article may include a first chain comprising first and second ends, where the first and second ends of the first chain attaches to the middle, and a mid section of the first chain attaches to the back portion. The jacket may include first and second crossing straps comprising first and second ends, where the first ends of the first and second crossing straps each attach to the front, and the second ends of the first and second straps extend around a back of a wearer, continue to a front of the wearer, and tie together in a knot.

Another aspect of the invention provides an article of clothing including a sleeved outer garment extending only from a shoulder region to a breastline, and first and second anchor lines attached to a bottom portion of the article of clothing.

According to another embodiment there is an article of clothing including a sleeved outer garment extending only from a shoulder region to a midriff region, first and second anchor lines attached to a front bottom portion of the article of clothing, each of the first and second anchor lines comprising a free end with a fastener attached thereto. The first and second anchor lines may be chains, and the fasteners may be spring-loaded attachment rings attachable to a belt loop.

Another aspect of the invention provides a jacket including a collar, first and second sleeves, first and second shoulder covering portions, first and second armpit portions, a front portion having a middle portion, a first side portion adjacent the first armpit portion, where the first side portion extends only between the first armpit portion and the first shoulder portion, a second side portion adjacent the second armpit portion, where the second side portion only extends between the second armpit portion and the second shoulder covering portion, a first arc extending up from the first armpit portion toward the collar and back down to the middle portion, and a second arc extending up from the second armpit portion toward the collar and back down to the middle. The jacket may also include first and second anchor lines comprising first and second ends, where the first ends of the first and second anchor lines each attach to the front and the second ends of the first and second anchor lines include fasteners for attachment to a clothing item at a wearer's hips. The jacket may alternatively include anchor straps comprising first and second ends, where the first and second ends extend from the front, loop around a wearer, and tie together to form a knot.

Another aspect of the invention provides a long-sleeve jacket that is cut such that the chest portion and the back portion end approximately 3 inches below a wearer's armpits. The bottom of the back portion and the bottom of the chest portion comprise a straight edge that is positioned proximate the wearer's middle-torso (midriff). The chest portion of this embodiment has an over-lapping closure flap and may include one or more snaps, buttons, Velcro or other attachments. To keep the jacket anchored while riding, the jacket may also include first and second anchor lines comprising first and second ends, where the first ends of the first and second anchor lines each attach to the front and the second ends of the first and second anchor lines include fasteners for attachment to a clothing item at a wearer's hips. The first and second anchor lines may be detachable chains or straps. Spring clips may be used to attach the straps to rings installed on the front of the jacket.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

The present invention provides articles of clothing that may be especially useful to motorcycle and equestrian riders, but is not limited to use by such riders. The present invention provides a shortened jacket that is more comfortable than traditional jackets, especially in warm weather. Jackets according to the present invention also accent the figures of female wearers.

As used throughout the claims and specification, the term "collar" refers to a part of a garment that encircles the neck of a wearer. "Hips" refer vertically to a region extending from approximately a navel to (and including) a pelvic area of a body. The words "including" and "having," as used in the specification, including the claims, have the same meaning as the word "comprising."

Figure 1:
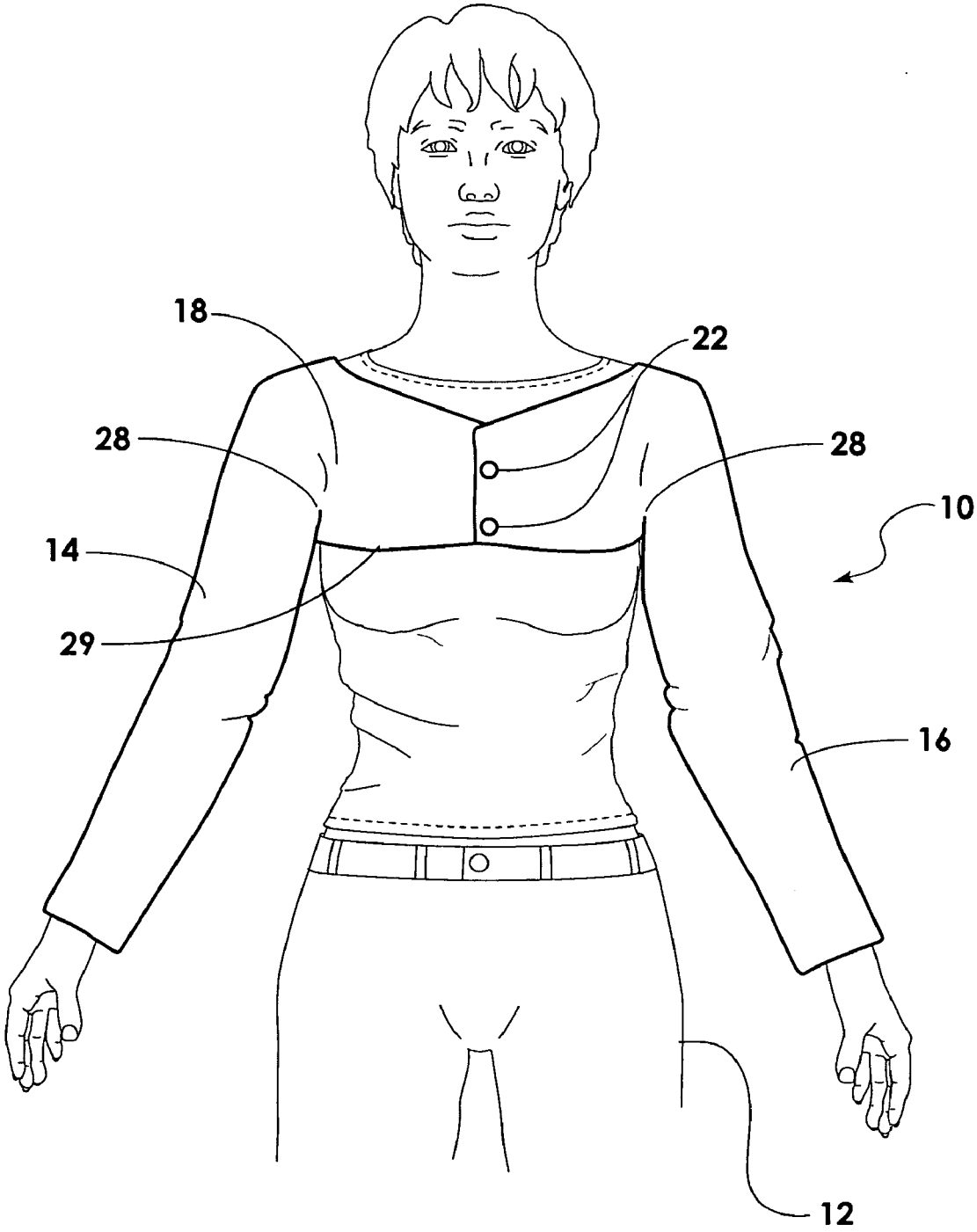
FIG. 1 is a front view of a jacket worn by a woman according to one embodiment of the present invention.
Figure 2:
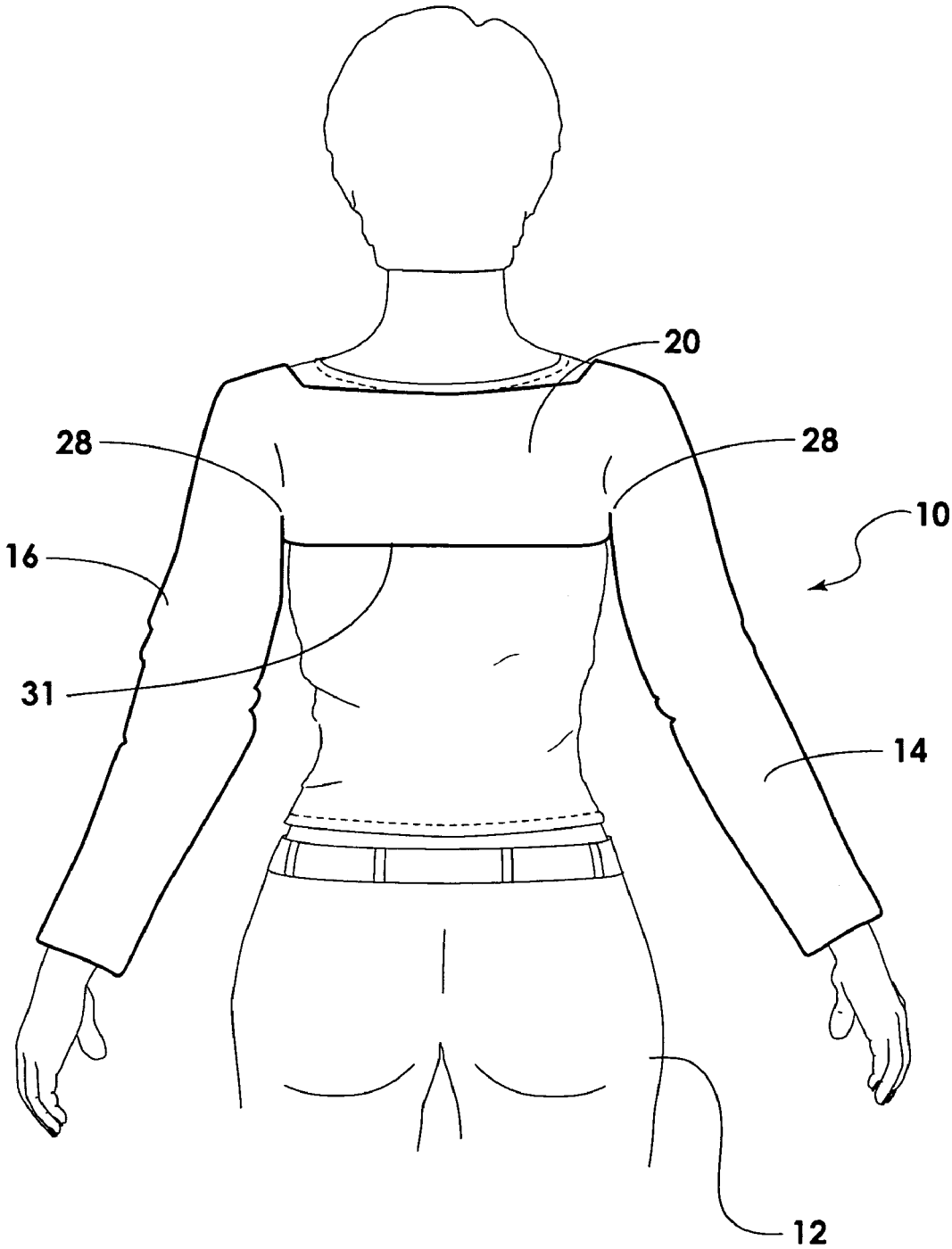
FIG. 2 is back view of the jacket shown in FIG. 1.

Turning now to the drawings, and in particular FIGS. 1-2, one embodiment of an article of clothing, for example a jacket 10, is shown according to principles of the present invention. FIG. 1 shows the jacket 10 from a front view and exhibited by a female wearer 12. FIG. 2 illustrates a back view of the jacket 10 on the same wearer 12.

The jacket 10 may be made of various materials that are commonly associated with motorcycle and equestrian jackets. These materials may include leather, denim, suede, and the like. However, other types of materials and fabrics, including nylon, polyester, and other synthetic and natural fabrics, as well as combinations of materials and fabrics, may also be used to make the jacket 10.

The jacket 10 comprises two sleeves 14, 16 that substantially cover the arms of the wearer 12. Preferably, the sleeves 14, 16 are sized to be "long sleeves" in that they extend from the shoulders of the wearer 12 to about the wrists of the wearer 12.

The jacket 10 further comprises a chest portion 18 and a back portion 20. The chest portion 18 is designed to cover a portion of the chest of the wearer 12 whereas the back portion 20 is designed to cover a portion of the back of the wearer 12. However, unlike prior jackets, the chest portion 18 is designed to be worn above the breastline of the wearer 12, which accents the figure of female wearers. One or more buttons 22 may also be added to the chest portion 18, thereby allowing the jacket 10 to enclose the wearer 12 or simply for decorative purposes. Of course, other types of fasteners such as zippers, snaps, ties, Velcro and the like, may also be used.

According to the embodiment of FIGS. 1-2, the jacket 10 is cut such that the chest portion 18 and the back portion 20 end proximate the armpit region 28 of the wearer 12. More particularly, in the embodiments shown in FIGS. 1 and 2, the jacket 10 is cut such that a bottom 29 of the chest portion 18 and a bottom 31 of the back portion 20 comprises a straight edge located near and extending between the armpit regions 28 of the wearer 12.

Figure 3:
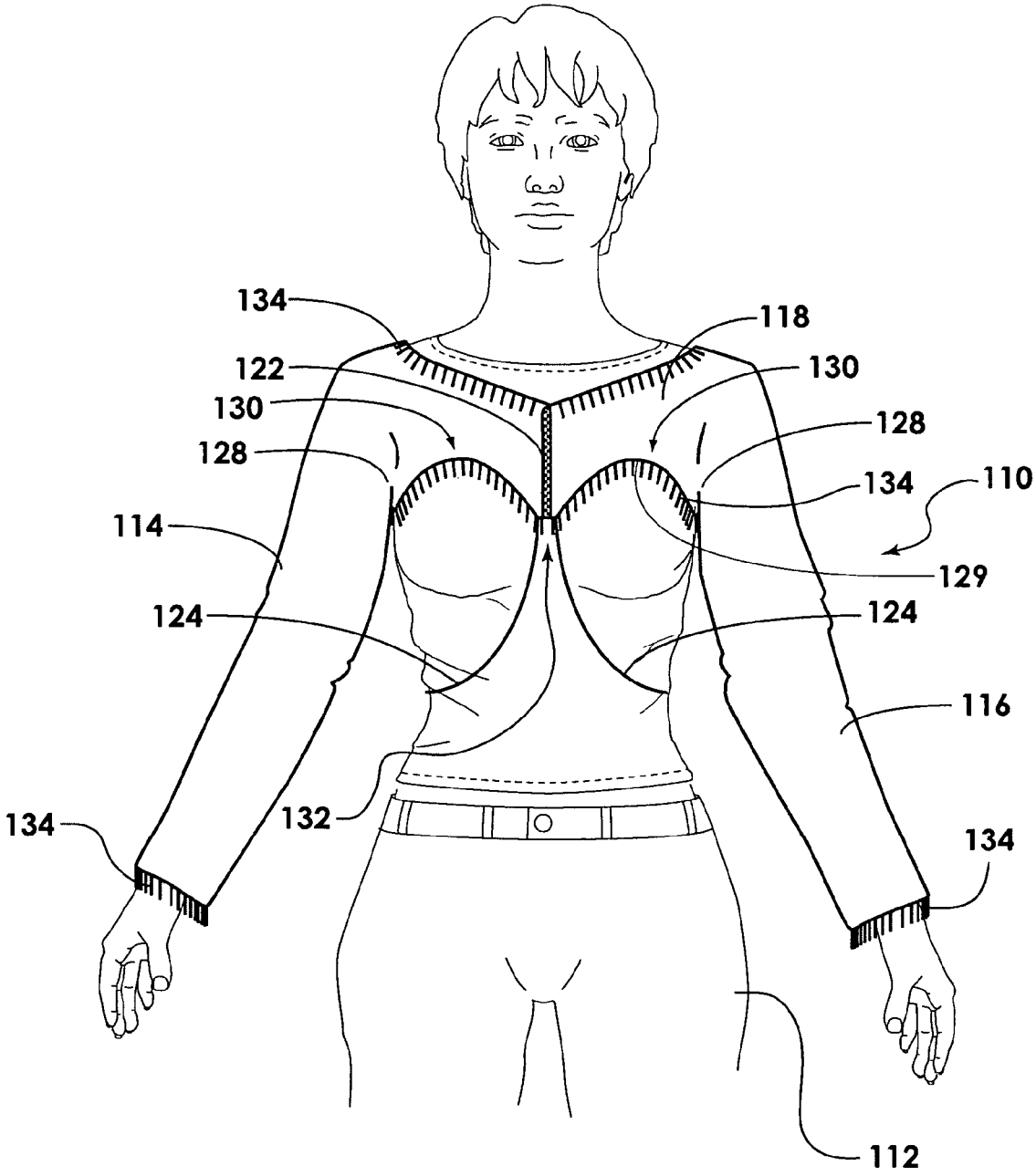
FIG. 3 is a front view of a jacket worn by a woman according to another embodiment of the present invention.
Figure 4:
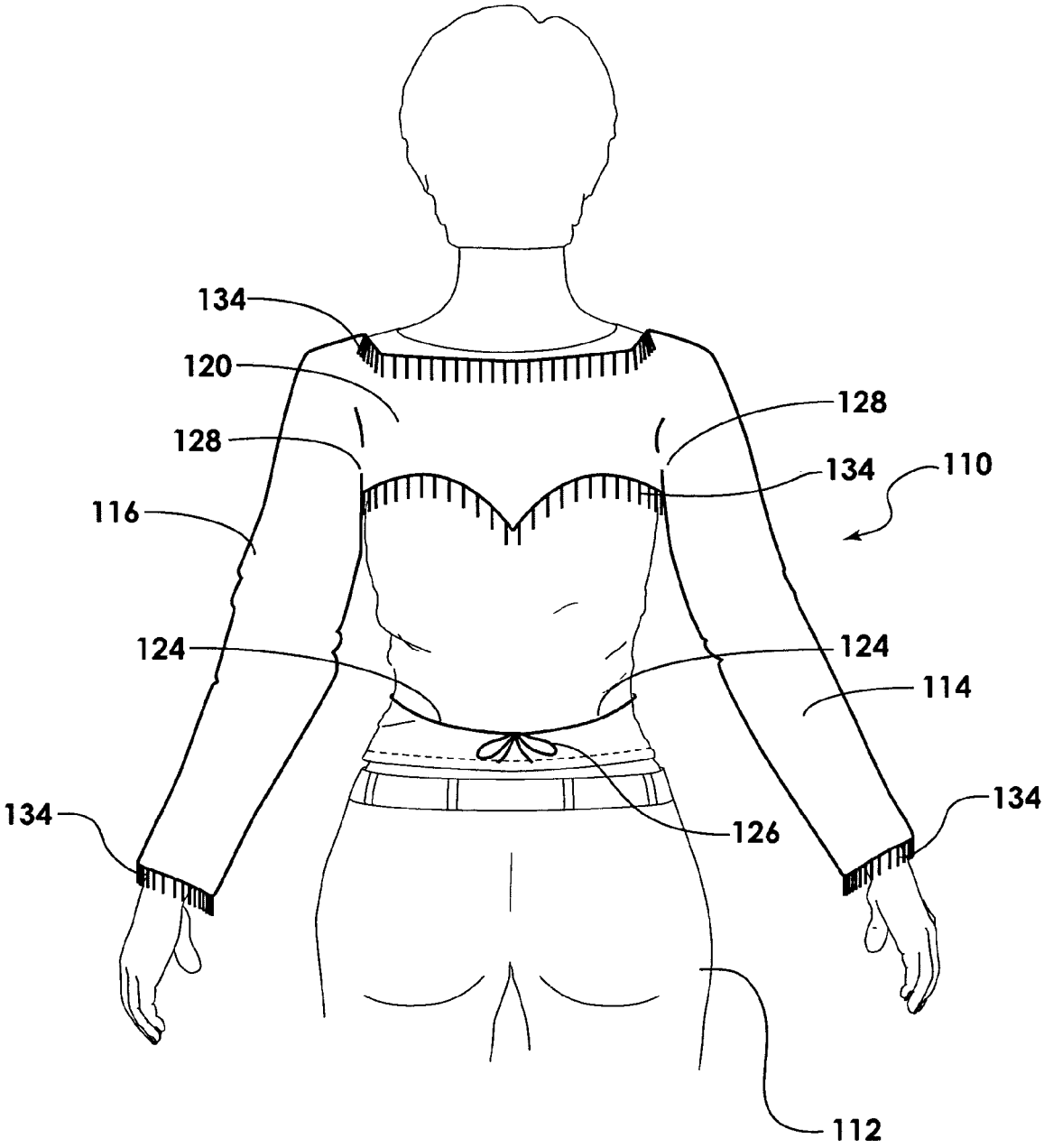
FIG. 4 is a back view of the jacket shown in FIG. 3.

Referring now to FIGS. 3 and 4, another embodiment of the present invention is illustrated. Similar to FIGS. 1-2, FIG. 3 shows an embodiment of a jacket 110 as viewed from the front of the wearer 112, and FIG. 4 shows the jacket 110 as viewed from the back of the wearer 112. As with the embodiments shown in FIGS. 1 and 2 and other embodiments disclosed herein, the jacket 110 may be made of various materials including, but not limited to: leather, denim, suede, and the like. Other fabrics and materials, as well as combinations of fabrics and materials, may also be used.

The jacket 110 also comprises two sleeves 114, 116 that cover the arms of the wearer 112. Preferably, the sleeves 114, 116 are sized to be "long sleeves" in that they extend from the shoulders of the wearer 112 to about the wrists of the wearer 112.

The jacket 110 further comprises a chest portion 118 and a back portion 120. The chest portion 118 is designed to cover a portion of the chest of the wearer 112 whereas the back portion 120 is designed to cover a portion of the back of the wearer 112. The chest portion 118 is designed to be worn at least partially above the breastline of the wearer 112. Preferably, a zipper 122 is added to the chest portion 118 to allow the jacket 110 to enclose the wearer 112. Other features such as buttons, ties, snaps and the like may also be used. Some embodiments, however, do not include any closing fasteners such as zippers, and are put on much like a shirt.

To further secure or anchor the jacket 110 to the wearer 112, one or more tie strings 124 may be added to the chest portion 118. In the embodiment shown in FIGS. 3 and 4, two tie strings 124 have been added. Preferably, the tie strings 124 are made such that they can wrap around the wearer 112 and tie together to form a knot 126. Of course, other mechanisms and/or methods for connecting the tie strings 124, including, but not limited to: fasteners, buckles, connectors, or the like, may also be used. The tie strings 124 may be particularly useful, for example, for motorcycle riders. Motorcycles often operate at high speeds, and the tie strings 124 prevent the chest portion 118 of the jacket 110 from flapping up in the wind.

The jacket 110 may be cut such that the chest portion 118 and the back portion 120 end proximate the armpit regions 128 of the wearer 112. Preferably, this is accomplished by having the jacket 110 cut such that the chest portion 118 and/or the back portion 120 are substantially V-shaped. As shown in FIG. 3, the jacket 110 is cut such that a bottom 129 of the chest portion 118 curves upwards from the armpit regions 128 to a first point 130 that is positioned above the breasts of the wearer 112 and then curves downwards to a second point 132 that is located between the breasts of the wearer 112.

As seen in FIGS. 3 and 4, the jacket 110 may also be trimmed with decorative fringe 134. This decorative fringe 134 may be added to various parts of the jacket 110 including the sleeves 114, 116, the chest portion 118, and/or the back portion 120. The decorative fringe 134 may comprise chains, strings, loops, or other trim decorations.

Figure 5:
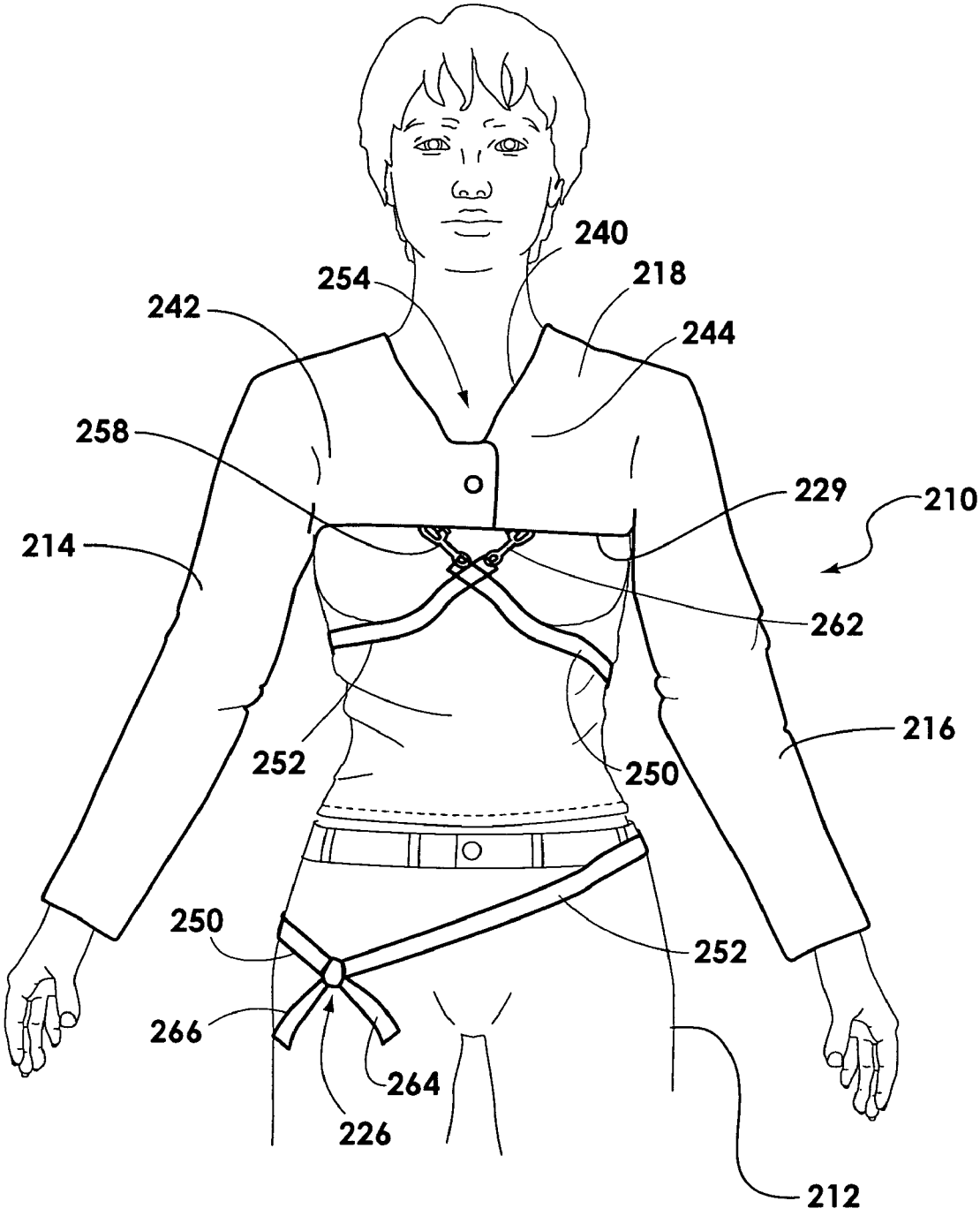
FIG. 5 is a front view of a jacket with anchoring straps worn by a woman according to another embodiment of the present invention.

Other jacket configurations according to principles of the present invention are also possible. For example, FIG. 5 illustrates in front view another shortened jacket 210. The jacket 210 includes a front 218, a collar 240, and a pair of long sleeves 214, 216. According to the embodiment of FIG. 5, the front 218 comprises first and second closable flaps 242, 244, shown in more detail in FIG. 6. The first and second closable flaps 242, 244 may overlap and are cut at least partially above a breastline as shown. A back 220 may also be cut at the same level as the first and second closable flaps 242, 244. As shown in the detail of FIG. 6, the first and second closable flaps 242, 244 may include Velcro strips 246, 248 that attach to one another and close the front 218.

Figure 6:
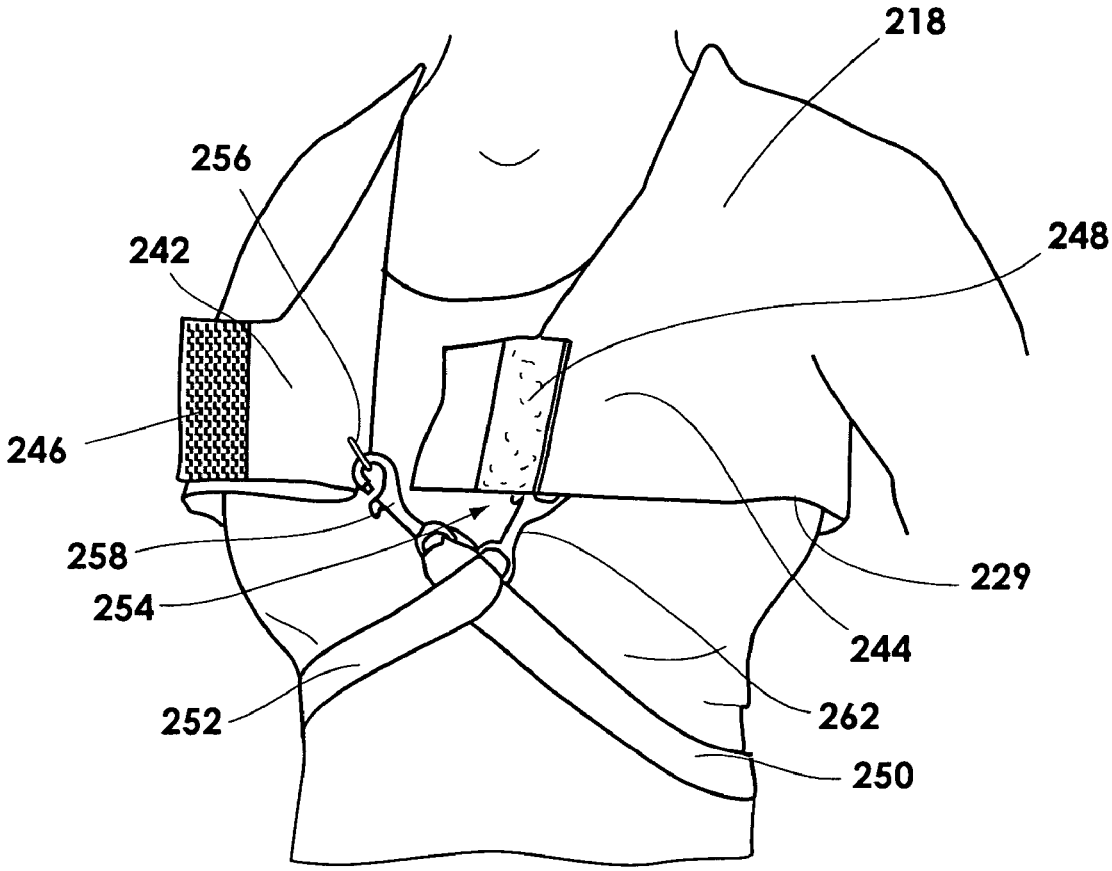
FIG. 6 is an enlarged front view of the jacket shown in FIG. 5 with the front flaps open.

As shown in FIGS. 5-6, the front 218 also includes an anchor line extending from a bottom portion 229 of the front 218. The anchor line of FIGS. 5-6 comprises first and second crossing straps 250, 252 that cross between the breasts of a wearer and are attached to a middle portion 254 of the front 218. According to FIG. 6, the first crossing strap 250 is attached to a first loop 256 on the first flap 242 via a first spring-loaded attachment ring 258, and the second crossing strap 252 is attached to a second loop (not shown, but similar or identical to first loop 256) via a second spring loaded attachment ring 262. However, the first and second crossing straps 250, 252 may also be stitched together as shown or even formed of or sewn into a single piece according to some embodiments. Distal ends 264, 266 of the first and second crossing straps 250, 252 are preferably of sufficient length to extend from the front 218, loop around the wearer 212, and tie together in a knot 226. The first and second crossing straps 250, 252 anchor the bottom 229 of the front 218 down.

Figure 7:
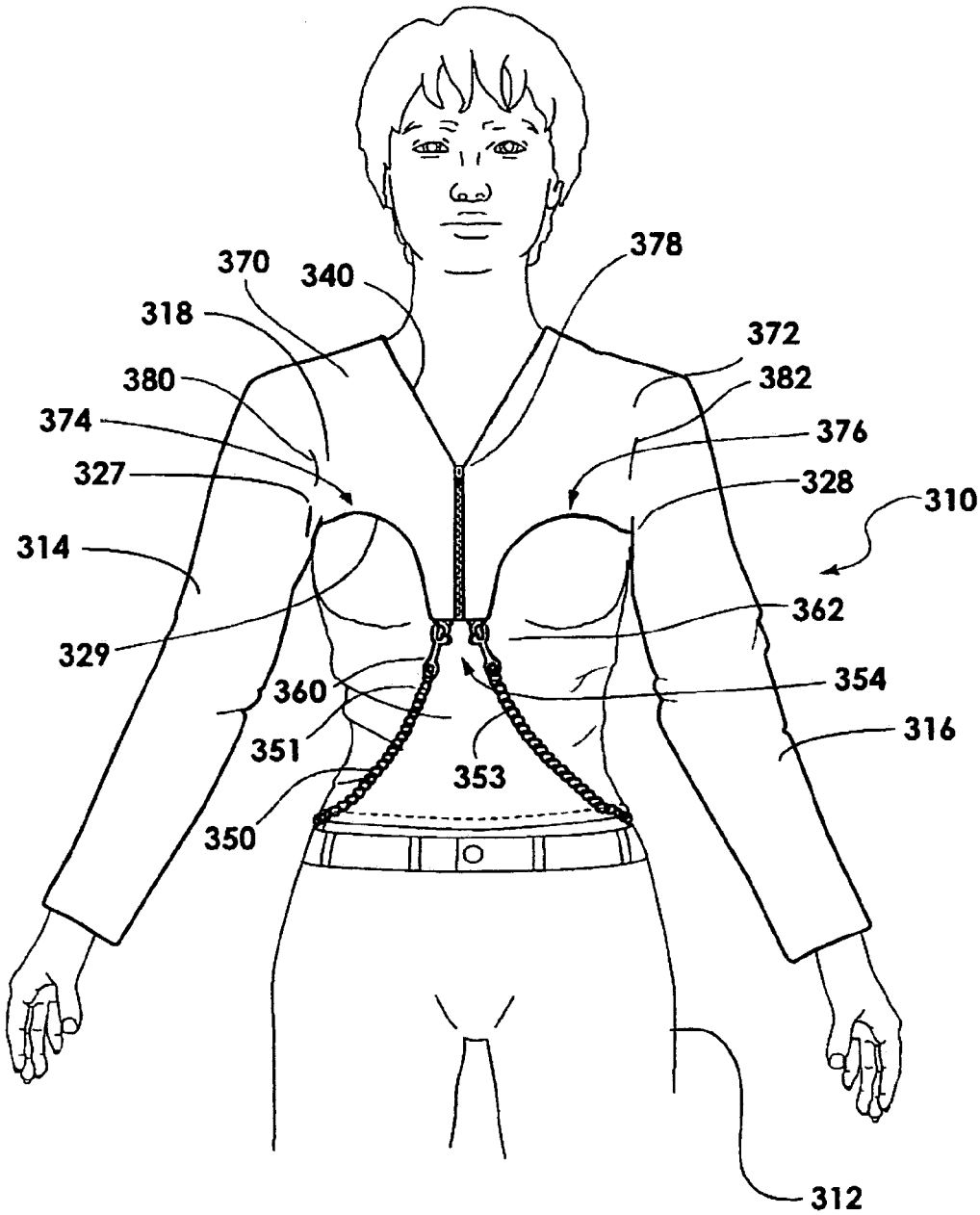
FIG. 7 is a front view of a jacket with anchoring chains worn by a woman according to another embodiment of the present invention.
Figure 8:
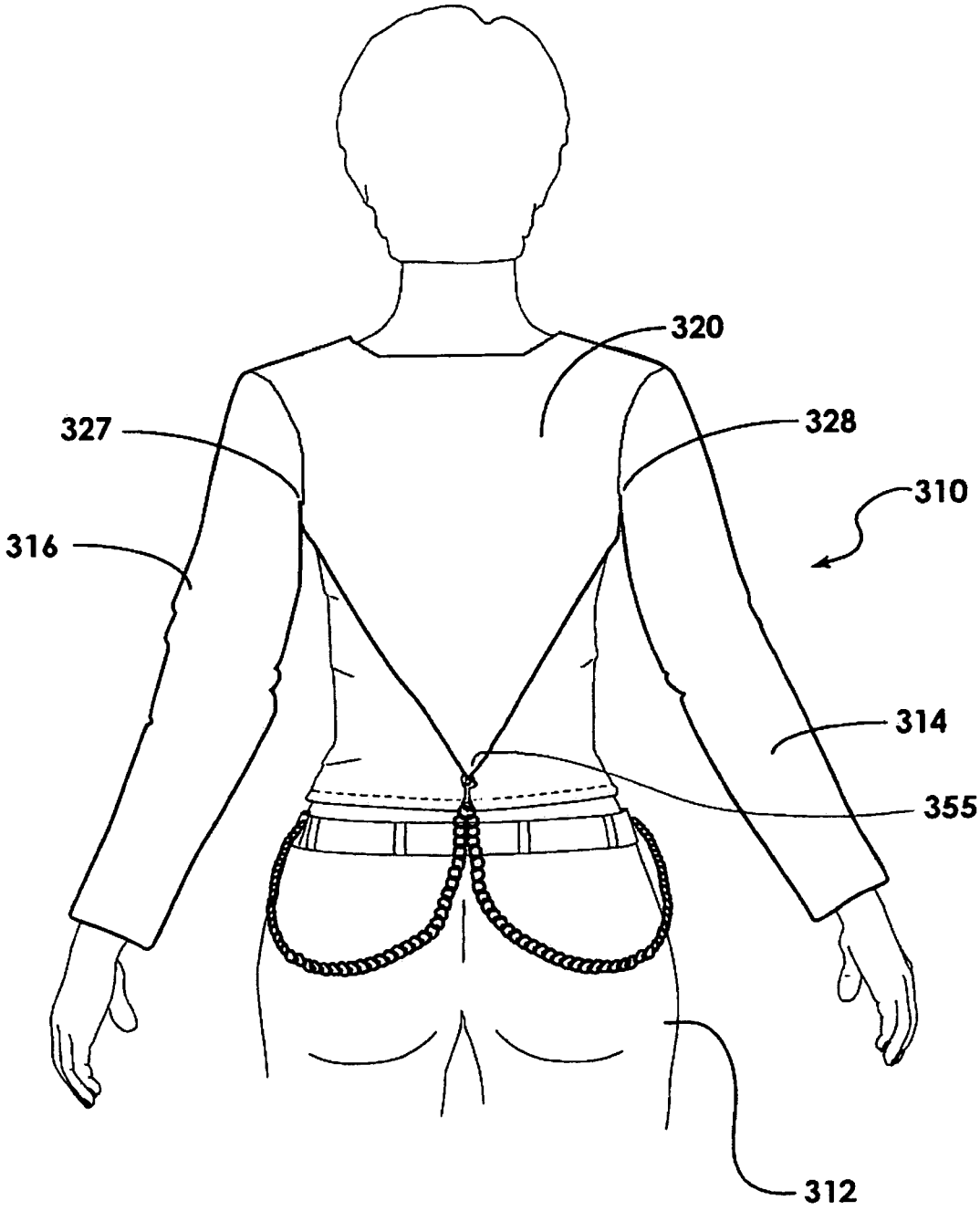
FIG. 8 is a back view of the jacket shown in FIG. 7.

Referring next to FIGS. 7-8, another embodiment of a jacket according to principles of the present invention is shown. As shown in FIGS. 7-8, a jacket 310 includes a collar 340, first and second sleeves 314, 316, first and second shoulder covering portions 370, 372, first and second armpit portions 327, 328, and a front portion 318 comprising first and second side portions 380, 382 adjacent to the first and second armpit portions 327, 328, respectively. According to some embodiments, the first side portion 380 extends only between the first armpit portion 327 and the first shoulder covering portion 370. Likewise, the second side portion 382 extends only between the second armpit portion 328 and the second shoulder covering portion 372. However, according to the embodiment of FIG. 7, the front portion 318 comprises a bottom edge 329 and a middle 354, and the bottom edge 329 includes a first arc 374 extending up from the first armpit portion 327 toward the collar 340 and back down to the middle 354. The first arc 374 is designed to extend at least partially over a woman's breast. As the first arc 374 comes to the middle 354, however, it may extend between and below a woman's breasts. Similarly, the bottom edge 329 also includes a second arc 376 extending up from the second armpit portion 328 toward the collar 340 and back down to the middle 354. The second arc 376 is also designed to extend at least partially over woman's breast, but as the second arc 376 comes down to the middle 354, it may extend between and below a woman's breasts, although it stops short of an adult wearer's navel.

The front portion 318 may thus comprise a general V or U shape, may include a zipper 378 or other fastener to facilitate putting on and taking off the jacket 310, and may have one or more attached anchor lines to anchor it, prevent wind-flapping, or simply to add decoration. According to FIGS. 7-8, the one or more attached anchor lines comprise a first chain 350 with first and second ends 351, 353 thereof attached to the front portion 318 via first and second spring-loaded rings 360, 362. The first chain 350 extends and attaches to a back portion 320 as shown in FIG. 8 at an approximate midpoint or midsection of the first chain 350. As shown in FIG. 8, the back portion 320 may taper from the first and second armpit portions 327, 328 to form a substantial V-shape, with a vertex 355 of the V-shape at approximately belt-height.

Figure 9:
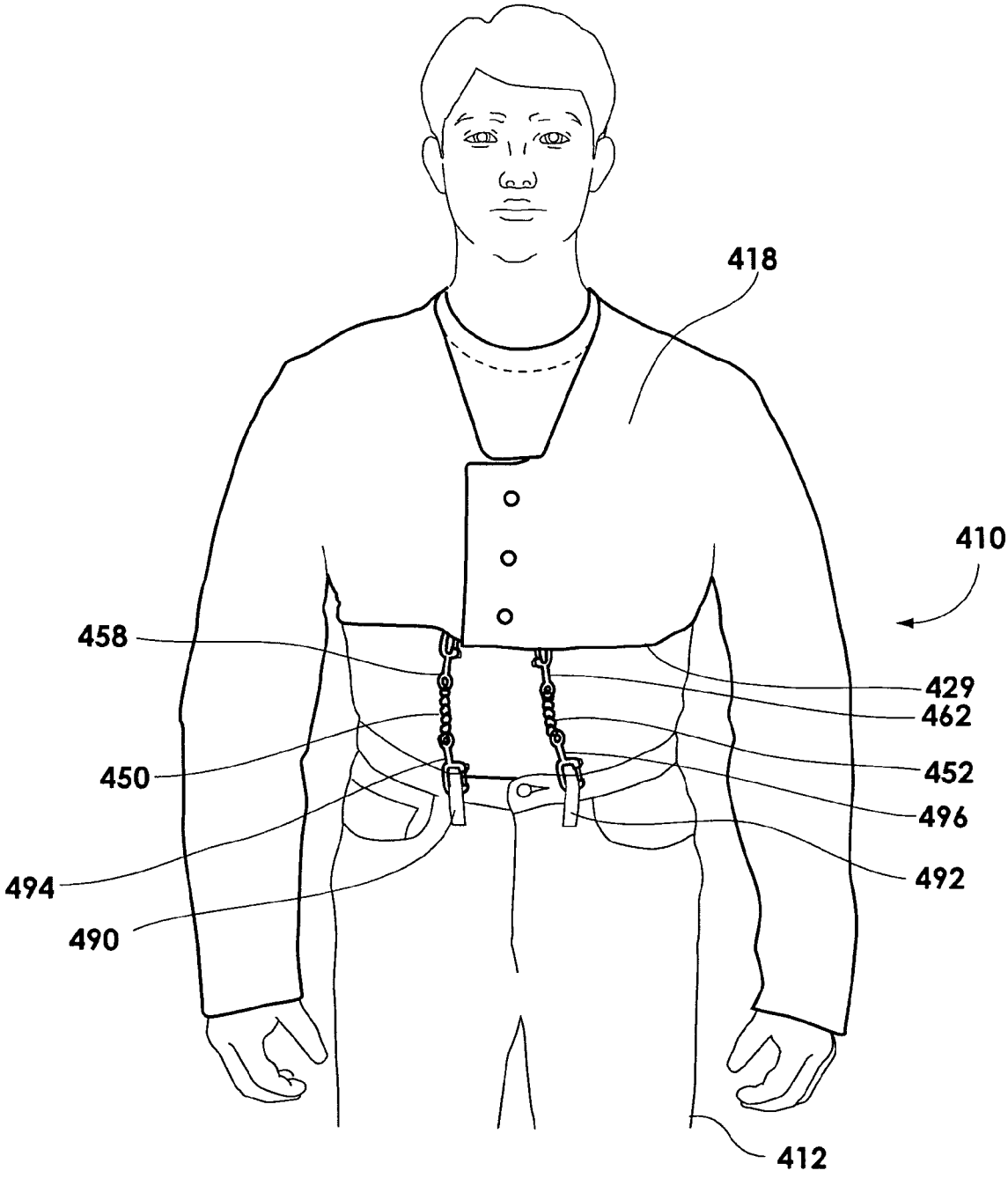
FIG. 9 is a front view of a jacket with anchoring chains worn by a man according to another embodiment of the present invention.

Although the embodiments shown and described above are particularly well suited for female wearers, other embodiments may be adapted for use by male wearers. For example, with reference to FIG. 9, a shortened jacket 410 is shown worn by a man 412. The jacket 410 includes front portion 418 extending only between the shoulders and the midriff of the man 412. According to FIG. 9, the jacket 410 is cut short approximately three inches below an armpit region. The bottom of both the front portion 418 and a back portion comprise a substantially straight edge. The front portion 418 has an overlapping closure flap that may include one ore more snaps, buttons, Velcro, or other fasteners. The jacket also includes a pair of anchor lines, which according to the FIG. 9 comprise first and second chains 450, 452. The first and second chains 450, 452 are each attached to the jacket 410 near a bottom edge 429 of the front portion 418 with fasteners, for example first and second biased closure rings 458, 462. Opposite ends of the first and second chains 450, 452, may also include fasteners, such as third and fourth biased closure rings 494, 496 for anchoring at a hip region of the man 412. For example, the first and second chains 450, 452 having the biased closure rings 494, 496 are shown attached to belt loops 490, 492, respectively.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A jacket comprising:

two sleeves;

a back panel;

two front panels;

said two front panels being secured together by a fastening means;

each of the said front panels having a bottom edge that curves upward from an armpit area to a first point that is positioned above the breast of a wearer and then curves downwardly to a second point that is located between the breasts of the wearer;

said back panel having a bottom edge that forms a v-shape extending from an armpit area to a waist region of the wearer;

a single chain having a first end, a second end, and a midpoint;

a first spring clip attached to the first end of said single chain, a second spring clip attached to the second end of said single chain, and a third spring clip attached to the midpoint of said single chain;

said first spring clip attached to the bottom edge of one of said front panels, the second spring clip attached to the other bottom edge of said front panels and the third spring clip attached to said bottom edge of the v-shaped back panel.

* * * * *